United States Patent [19]

Bruneau

[11] Patent Number: 4,486,956

[45] Date of Patent: Dec. 11, 1984

[54] CONTROL DEVICE FOR DRAWING INSTRUMENTS

[75] Inventor: Alain Bruneau, Montferrand Le Chateau, France

[73] Assignee: Alpia S.A., Besancon, France

[21] Appl. No.: 456,839

[22] Filed: Jan. 10, 1983

[30] Foreign Application Priority Data

Jan. 11, 1982 [FR] France ..... 82 00281

[51] Int. Cl.[3] ..... B43L 13/08

[52] U.S. Cl. ..... 33/438

[58] Field of Search ..... 33/438, 497, 499, 500

[56] References Cited

U.S. PATENT DOCUMENTS

| | | | |
|---|---|---|---|
| 3,667,126 | 6/1972 | Wackerfuss | 33/438 |
| 3,758,953 | 9/1973 | Bruneau | 33/438 |

FOREIGN PATENT DOCUMENTS

| | | | |
|---|---|---|---|
| 832867 | 2/1952 | Fed. Rep. of Germany | 33/438 |
| 1190838 | 4/1965 | Fed. Rep. of Germany | 33/438 |
| 1511477 | 9/1969 | Fed. Rep. of Germany | 33/438 |
| 645614 | 11/1950 | United Kingdom | 33/438 |
| 543530 | 3/1977 | U.S.S.R. | 33/438 |

*Primary Examiner*—Richard R. Stearns

*Attorney, Agent, or Firm*—Robert E. Burns; Emmanuel J. Lobato; Bruce L. Adams

[57] ABSTRACT

This control device consists of a slider disposed within the portion of the hollow head which rotates with the rules; this slide is provided with a guide T-shaped and member is pivotally interconnected to a thumb-piece accessible from outside the head. The pivotal connection between the slider and the thumb-piece is constantly maintained through a coil compression spring prestressed between the inner wall of the head and a stud rigid with the slider opposite the pivotal connection. The thumb-piece comprises on its bottom a projection engageable in a cavity formed in the head base. The relative positions of the pivotal connecting means and the projection are so calculated that the spring generates a self-locking torque preventing any uncontrolled released of the mechanism.

5 Claims, 5 Drawing Figures

Fig. 2
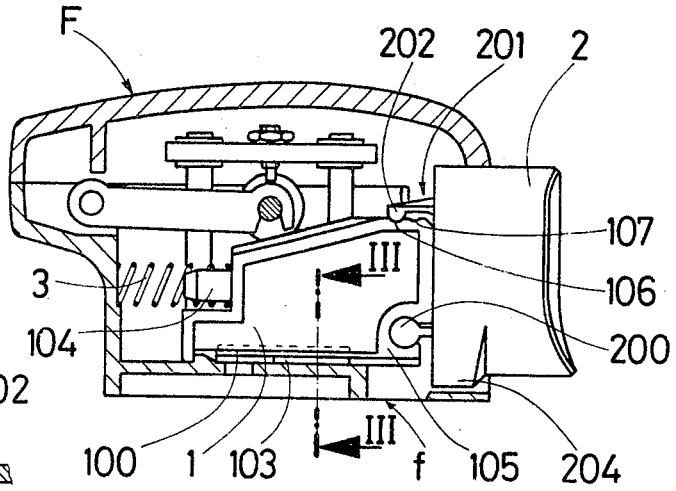
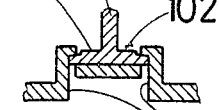
Fig. 3
Fig. 4
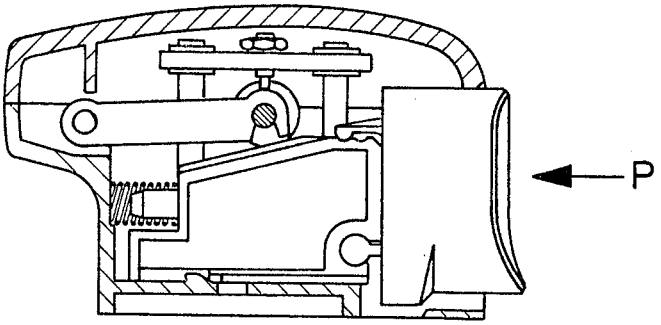
Fig. 5
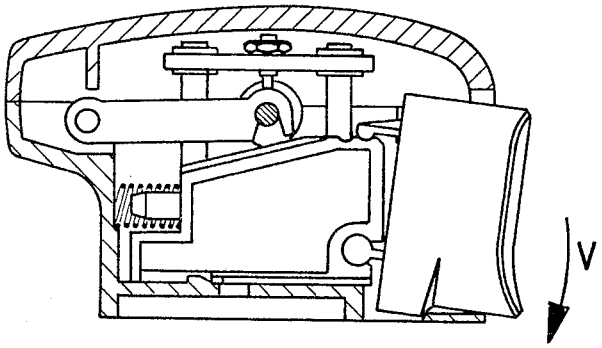

CONTROL DEVICE FOR DRAWING INSTRUMENTS

BACKGROUND OF THE INVENTION

The present invention relates to drawing instruments, and more particularly to a device for controlling the mechanism for setting the angular position of the pair of rules usually associated with the head of a drawing apparatus.

These rules cannot be pivoted unless a control member, of which different forms are known in the art, is actuated for disengaging the mechanical indexing means provided for detent positioning the rules in predetermined or main angular positions.

This mechanical indexing system may be held in its release position either by the draftsman's continuous action or by setting a lock bolt performing the same function.

To restore the indexing position in one of the main angular positions provided by the detent positioning means, the operator must stop his holding action or remove the bolt.

THE PRIOR ART

In most known apparatus of this character the indexing mechanism and the lock bolt constitute a same and single member.

This member comprises a projecting portion such that, when this portion is moved to different positions, it can be locked in the desired position by simply shifting the assembly, i.e. the indexing mechanism control member and the bolt, so as to cause the projecting portion to snappily engage a suitable aperture or notch. However, this engagement is sometimes untimely.

A known device comprises two separate component elements, namely a control member and a lock member which have to be actuated separately.

SUMMARY OF THE INVENTION

It is the primary object of the present invention to provide a device for controlling the angular indexing mechanism, which comprises locking means permitting either a free rotation of the rules without any risk of untimely or unexpected locking thereof, or an efficient locking of the rules in a predetermined angular position, the two functions being obtained by performing a single manoeuver, by simply varying the direction in which pressure is exerted on a single push member.

For this purpose, the device according to the instant invention is characterized in that the mechanism for detent positioning the rules and releasing same when necessary is controlled by a sliding member disposed within the mechanism's head portion rotating integrally with the rules, said sliding member being provided with guide means and operatively connected through ball-joint means to a thumb-piece or push-button provided with locking means and accessible from outside the head.

The essential advantage characterizing this device is its particularly simple and easy operation and the efficiency of the means locking the control thumb-piece.

Other features and advantages characterizing this invention will appear as the following description proceeds with reference to the accompanying drawing illustrating diagrammatically by way of example a typical form of embodiment thereof.

THE DRAWING

FIG. 2 is a section taken along the line II—II of FIG. 1;

FIG. 3 is a section taken along the line III—III of FIG. 2;

FIG. 4 is a view similar to FIG. 2 but showing the device in its release or depressed position, and FIG. 5 is a similar view showing the device in its locked position.

DESCRIPTION OF THE PREFERRED EMBODIMENT

Figure 1:
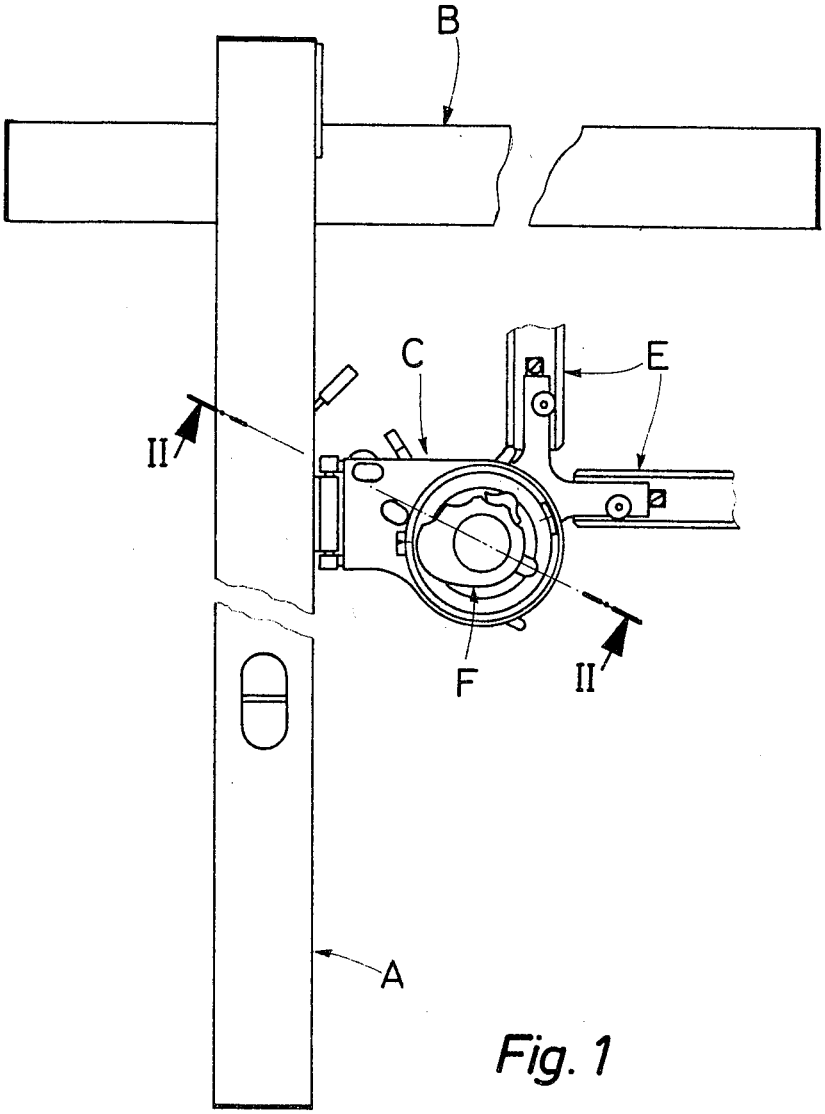
FIG. 1 is a general top view of the drawing instrument.

Reference will firstly be made to FIG. 1 of the drawing, illustrating the general arrangement of a drawing apparatus comprising a movable rail A adapted to travel through carriage means on another rail B secured to a working surface or drawing board, so that the rail A remains constantly perpendicular to rail B.

The drawing apparatus C proper, secured to a carriage carrying the rules E pivotally mounted about a head F, is movable for translation along the rail A.

FIG. 2 illustrates in section taken along the line II—II of FIG. 1 the head F adapted to be rotated for pivoting the rules E disposed at right angles to each other.

The device for controlling the indexing mechanism to permit the setting of the rules in the desired angular position comprises a slider 1 disposed within the head F and a thumb-piece or push-knob 2 of which one portion projects from the outer peripheral surface of head F.

The slider 1 is movable bodily with the head F through guide means consisting of a T-section member having a central web 100 and a pair of lateral wings 101, 102 (FIG. 3) secured to the base of the slider and slidably engaged in a slideway 103 anchored within the head F.

The end of slider 1 opposite the thumb-piece 2 comprises a stud 104 surrounded by one end of a coil compression spring 3 prestressed between the inner wall of head F and the base of stud 104 rigid with slider 1. The other end of slider 1 adjacent the thumb-piece 2 has formed in its lower end a socket-forming cavity 105 engageable by a ball 200 and in its lower upper portion a pair of parallel grooves 106, 107 engageable by a hook member 201 constituting a pivotal mounting for the thumb-piece 2 in relation to the slider 1. The hook member 201 comprises a rib 202 engaging by turns one of the grooves 106,107. Moreover, the thumb-piece 2 comprises at its bottom substantially parallel to the base of slider 1 a projecting portion 204 engageable in a corresponding cavity f formed in the base of head F.

When the draftsman depresses the thumb-piece 2 in the direction of the arrow P of FIG. 4, i.e. parallel to the drawing board surface, the slider 1 is moved in its slideway 103 and compresses the coil spring 3 against the inner wall of head F, thus releasing the angular indexing mechanism and permitting the free rotation of the pair of rules E. When the operator releases the thumb-piece 2, the control device, i.e. the slider 1 connected to the thumb-piece through the pivotal mounting means 105, 200 and the indexing mechanism, stops the rotation of the pair of rules E. Since the slider 1 and thumb-piece 2 are safely interconnected through the hook member 201 and ball 200, any untimely or undesired locking action is safely prevented. The indexing mechanism may be held in the position permitting the free rotation of the rules E by exerting a complementary pressure but in the direction of the arrow V on the thumb-piece 2, i.e. towards the drawing-board, so that the rib 202 will move out from groove 106 and subsequently engage the other groove 107, while the thumb-piece 2 is fulcrumed on ball 200 while remaining properly connected to slider 1 through the hook member 2 until the projecting portion 204 of thumb-piece 2 engages the cavity f formed in the bottom of head F, thus locking the mechanism in its free-rotation position. The pressure P exerted on the thumb-piece 2 may thus be released, since the indexing mechanism is still locked by the action of compression spring 3 holding the projection 204 in cavity f. The positions of ball 200 and projection 204 are so calculated that the spring 3 exerts a self-locking action preventing any uncontrolled release movement thereof.

What is claimed is:

1. A device for controlling a mechanism for setting the angular position of a pair of rules extending from a head of a drawing apparatus, which comprises a slider mounted within a portion of the head rotating with the rules which comprises means for guiding the movements of translation of said slider, said means comprising a T-section member having a web and two lateral wings and being secured to the base of said slider, and a slideway secured to said head and slidably engaged by said T-section member, said slider being connected through pivot means to a thumb-piece accessible from the exterior of the head and means for locking said thumb-piece wherein said pivot means interconnecting said slider and said thumb-piece comprises a ball rigid with said thumb-piece and engaged in a socket-forming cavity of said slider which is located adjacent their area of mutual contact, slightly above said T-section member.

2. The control device of claim 1, wherein said thumb-piece comprises on its face engaging said slider and opposite said ball, a hook member provided with a rib on its free end, said slider having formed thereon a pair of parallel grooves adapted to be engaged alternatively by said rib of said hook member.

3. The control device of claim 2, wherein said locking means comprises a projecting portion of said thumb-piece which is formed under the thumb-piece portion carrying said ball, the dimensions of said projecting portion corresponding to those of a cavity formed in said head and engageable by said projection for locking the device in the position which permits the free rotation of the rules, and a coil compression spring prestressed between the inner wall of said head and the base of a stud rigidly secured to said slider, whereby a complementary pressure exerted on said thumb-piece in the direction of the drawing-board surface is sufficient for generating under the force of said coil compression spring a self-locking torque safely preventing any uncontrolled disengagement of said projection from said cavity.

4. A device for controlling a mechanism for setting the angular position of a pair of rules extending from a head of a drawing apparatus, which comprises a slider slidably mounted within said head and movable between a locking position in which said pair of rules is held against rotation and a released position in which said pair of rules is released for rotation, spring means biasing said slider toward locking position, a thumb-piece pivotally connected to said slider for moving said slider against the action of said spring means from locking position to released position, and a projecting portion on said thumb-piece engageable in a recess in a base portion of said head, said thumb-piece being pivotally movable, when said slider is in released position, to bring said projecting portion into engagement in said recess to hold said slider in said released position.

5. The control device of claim 4, in which the pivotal connection of said thumb-piece with said slider comprises a pivot at a lower portion of said thumb-piece and slider, and in which a hook member provided on an upper portion of said thumb-piece is engageable with ribs on an upper portion of said slider to retain said thumb-piece in a position to which it is pivoted, said projecting portion being on a lower portion of said thumb-piece and being engageable with said recess by downward pivoting of said thumb-piece.

* * * * *